US008217745B2

(12) United States Patent
Tien et al.

(10) Patent No.: US 8,217,745 B2
(45) Date of Patent: Jul. 10, 2012

(54) INDUCTOR AND BASE THEREOF

(75) Inventors: Ching-Hsiang Tien, Taoyuan Hsien (TW); Yu-Chin Chen, Taoyuan Hsien (TW); Ming-Cheng Li, Taoyuan Hsien (TW); Zhi-Liang Zhang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 6 days.

(21) Appl. No.: 12/845,415

(22) Filed: Jul. 28, 2010

(65) Prior Publication Data

US 2011/0025441 A1 Feb. 3, 2011

(30) Foreign Application Priority Data

Jul. 31, 2009 (TW) ..... 98125996 A

(51) Int. Cl.
*H01F 27/02* (2006.01)
*H01F 27/06* (2006.01)
*H01F 27/30* (2006.01)

(52) U.S. Cl. ..... 336/83; 336/65; 336/90; 336/92; 336/98; 336/196; 336/199

(58) Field of Classification Search ..... None
See application file for complete search history.

(56) References Cited

U.S. PATENT DOCUMENTS

| | | | | |
|---|---|---|---|---|
| 4,748,405 | A * | 5/1988 | Brodzik et al. | 324/127 |
| 6,081,180 | A * | 6/2000 | Fernandez et al. | 336/90 |
| 6,239,682 | B1 * | 5/2001 | McCloskey | 336/90 |
| 6,753,749 | B1 * | 6/2004 | Chin | 336/90 |
| 7,567,161 | B2 * | 7/2009 | Monma | 336/83 |
| 7,834,730 | B2 * | 11/2010 | Nieto et al. | 336/65 |
| 2004/0041676 | A1 * | 3/2004 | Okamoto | 336/90 |
| 2008/0055035 | A1 * | 3/2008 | Gerhard | 336/84 C |

* cited by examiner

*Primary Examiner* — Mohamad Musleh
*Assistant Examiner* — Ronald Hinson
(74) *Attorney, Agent, or Firm* — Kirton McConkie; Evan R. Witt

(57) ABSTRACT

An inductor includes a base and a winding assembly. The base includes an outer frame, a middle part and a connecting part. The outer frame has a first upper surface. The middle part has a second upper surface. The connecting part is connected with the outer frame and the middle part and has a third upper surface. The connecting part, the outer frame and the middle part collectively define a receptacle. The winding assembly is accommodated within the receptacle. The second upper surface of the middle part is disposed at a higher level with respect to the first upper surface of the outer frame. A first height is defined by the level difference between the second upper surface and the third upper surface. A second height of the winding assembly is smaller than the first height, so that a fourth upper surface of the winding assembly is disposed at a lower level with respect to the second upper surface after the winding assembly is accommodated within the receptacle.

19 Claims, 6 Drawing Sheets

INDUCTOR AND BASE THEREOF

FIELD OF THE INVENTION

The present invention relates to an inductor, and more particularly to an inductor having a controllable height. The present invention also relates to a base of the inductor.

BACKGROUND OF THE INVENTION

Magnetic elements such as inductors are widely used in many electronic devices. Recently, the electronic devices are developed toward minimization. For reducing the overall volume of the electronic devices, the inductors and the conductive winding assemblies of the inductors are gradually reduced.

FIG. 1 is a schematic perspective view illustrating a conventional inductor. As shown in FIG. 1, the inductor 1 comprises a winding assembly 11 and a base 12. The winding assembly 11 is disposed on an upper surface 120 of the base 12. The winding assembly 11 comprises a magnetic core 110 and a winding coil 111. The magnetic core 110 is ring-shaped. The winding coil 111 is wound around the ring-shaped magnetic core 110. Several pins 121 are mounted on the base 12. The pins 121 have bending structures. Both terminals of the winding coil 111 are respectively wound around and connected to two different pins 121. The contact portions 121*a* of the pins 121 are connected to a circuit board (not shown), so that the winding coil 111 is electrically connected with the circuit board through the pins 121.

In the conventional inductor 1, the winding coil 111 is directly wound around the pins 121. In a case that the diameter of the winding coil 111 is relatively large, the pins 121 are readily suffered from deformation during the winding process. Under this circumstance, the performance of the inductor 1 is deteriorated. Moreover, the inductor 1 could be directly arranged on a circuit board according to a surface mount technology (SMT), and thus the inductor 1 could be also referred as a surface mount magnetic device (SMD). After the inductor 1 is placed on the circuit board by a placement machine, the inductor 1 and the circuit board are heated in a reflow furnace and thus the pins 121 of the inductor 1 are welded on the circuit board. If the pins 121 are suffered from deformation, a poor contact problem of the inductor 1 occurs.

Since the winding coil 111 is directly wound around the pins 121, the height h1 of the winding assembly 11 is also determined by the diameter of the winding coil 111. If the diameter of the winding coil 111 is relatively large, the height h1 of the winding assembly 11 is increased and thus the evenness of the winding assembly 11 is insufficient. In addition, since the winding assembly 11 is disposed on the upper surface 120 of the base 12, the total height of the inductor 1 is equal to the sum of the height h1 of the winding assembly 11 and the height h2 of the base 12. In other words, it is difficult to precisely control the overall height of the inductor 1. In addition, the layout space of the inductor 1 is very large.

For increasing throughput and yield, the inductor 1 should be mounted on the circuit board by an automatic placement process according to the surface mount technology (SMT). Since the evenness of the winding assembly 11 is insufficient, the upper surface of the winding coil 111 is not suitable as a sucking surface to be picked up by the automatic placement machine. In other words, the inductor 1 is manually mounted on the circuit board and thus the fabricating cost is increased.

There is a need of providing an improved inductor so as to obviate the drawbacks encountered from the prior art.

SUMMARY OF THE INVENTION

It is an object of the present invention to provide an inductor having a flat sucking surface, so that the inductor is suitable to be mounted on a circuit board by an automatic placement process and the overall height of the inductor could be precisely controlled.

Another object of the present invention provides a base of an inductor, in which the problem of causing deformation of the pins of the base is minimized.

In accordance with an aspect of the present invention, there is provided an inductor. The inductor includes a base and a winding assembly. The base includes an outer frame, a middle part and a connecting part. The outer frame has a first upper surface. The middle part is disposed within the outer frame and has a second upper surface. The connecting part is connected with the outer frame and the middle part and has a third upper surface. The connecting part, the outer frame and the middle part collectively define a receptacle. The winding assembly is accommodated within the receptacle and has a fourth upper surface. The second upper surface of the middle part is disposed at a higher level with respect to the first upper surface of the outer frame. A first height is defined by the level difference between the second upper surface of the middle part and the third upper surface of the connecting part. A second height of the winding assembly is smaller than the first height, so that the fourth upper surface of the winding assembly is disposed at a lower level with respect to the second upper surface of the middle part after the winding assembly is accommodated within the receptacle.

In accordance with another aspect of the present invention, there is provided a base of an inductor. The inductor includes a winding assembly. The base includes an outer frame, a middle part and a connecting part. The outer frame has a first upper surface. The middle part is disposed within the outer frame and has a second upper surface. The connecting part is connected with the outer frame and the middle part and has a third upper surface. The connecting part, the outer frame and the middle part collectively define a receptacle. The second upper surface of the middle part is disposed at a higher level with respect to the first upper surface of the outer frame. A first height is defined by the level difference between the second upper surface of the middle part and the third upper surface of the connecting part. A second height of the winding assembly is smaller than the first height, so that a fourth upper surface of the winding assembly is disposed at a lower level with respect to the second upper surface of the middle part after the winding assembly is accommodated within the receptacle.

In accordance with a further aspect of the present invention, there is provided a base of an inductor. The inductor includes a winding assembly. The base includes an outer frame, a middle part, a connecting part, a plurality of conducting parts and a plurality of pins. The middle part is disposed within the outer frame. The connecting part is connected with the outer frame and the middle part. Each conducting part has a first terminal connected with the winding assembly and a second terminal connected with a corresponding pin. The pin is electrically connected to a circuit board.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
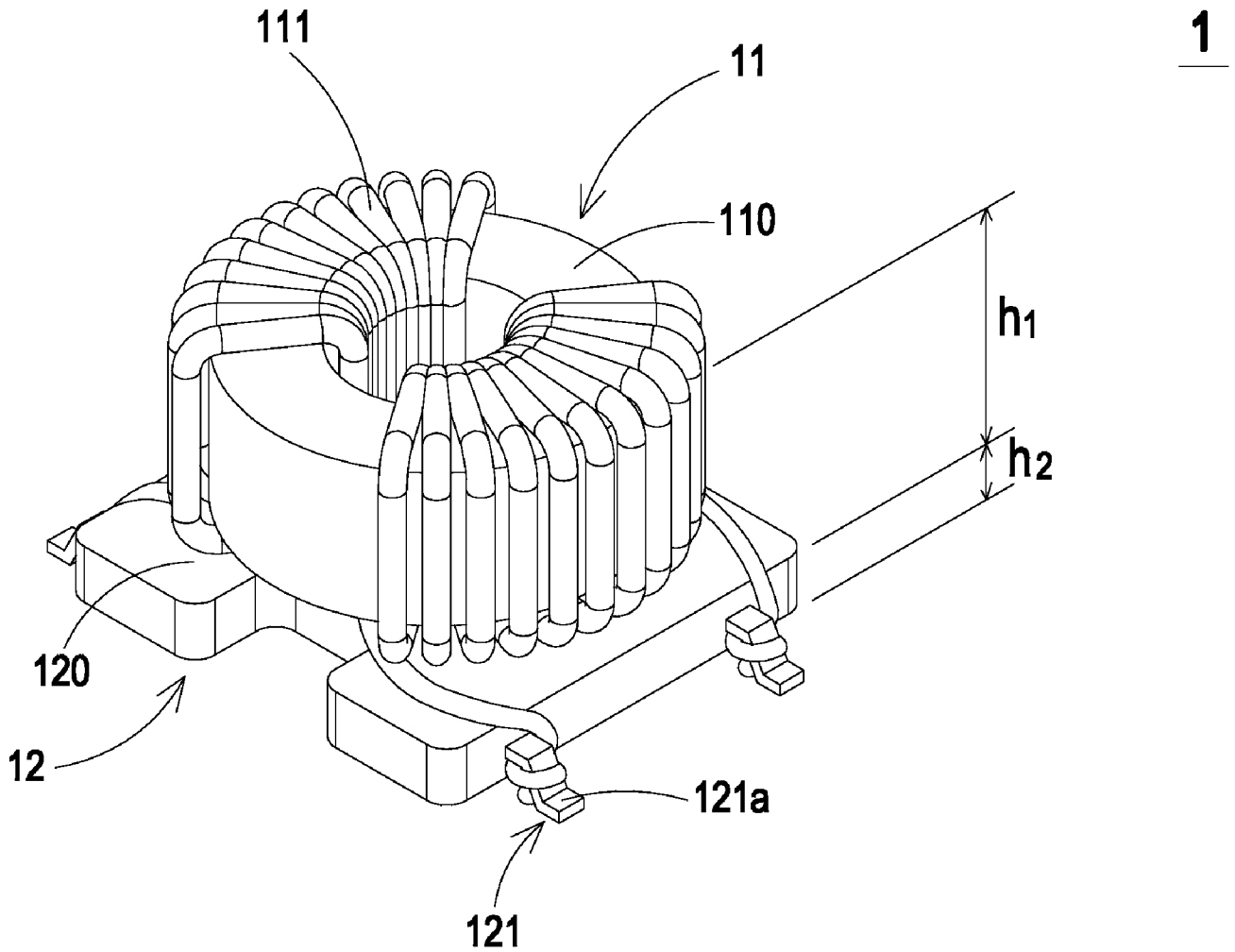
FIG. 1 PRIOR ART
FIG. 1 is a schematic perspective view illustrating a conventional inductor.
Figure 2:
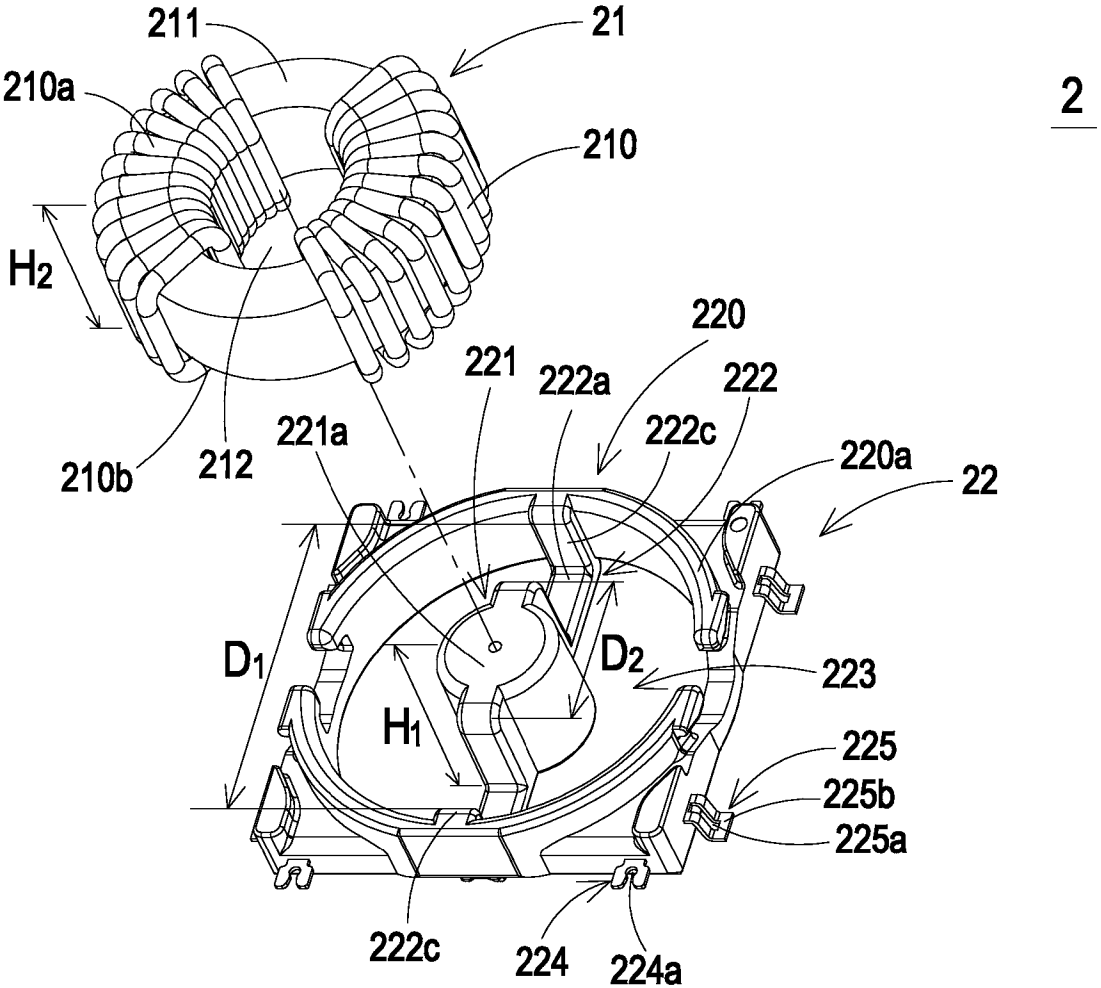
FIG. 2 is a schematic exploded view illustrating an inductor according to a first embodiment of the present invention.

FIG. 2 is a schematic exploded view illustrating an inductor according to a first embodiment of the present invention. As shown in FIG. 2, the inductor 2 comprises a winding assembly 21 and a base 22. The winding assembly 21 comprises at least one winding coil 210 and a magnetic core 211. In this embodiment, the magnetic core 211 is ring-shaped and has a channel 212. The winding coil 210 is wound around the ring-shaped magnetic core 211. In some embodiments, the winding assembly 21 comprises two or four winding coils 210. The number of the winding coils 210 is varied according to the practical requirements. After the winding coil 210 is wound around the ring-shaped magnetic core 211, a second height $H_2$ of the winding assembly 21 is substantially equal to the level difference between a fourth upper surface 210*a* and a fourth lower surface 210*b* of the winding coil 210.

The base 22 comprises an outer frame 220, a middle part 221 and a connecting part 222. The outer frame 220 is substantially a square structure having a central hollow portion. The outer frame 220 comprises a first upper surface 220*a* and a first lower surface 220*b* (see FIG. 3A). The middle part 221 comprises a second upper surface 221*a*. The second upper surface 221*a* is disposed at a higher level with respect to the first upper surface 220*a* of the outer frame 220. The connecting part 222 is connected with the outer frame 220 and the middle part 221. The connecting part 222 comprises a third upper surface 222*a* and two extension arms 222*c*. The extension arms 222*c* are disposed on the inner wall of the outer frame 220. The third upper surface 222*a* of the connecting part 222, the outer frame 220 and the middle part 221 collectively define a receptacle 223 for accommodating the winding assembly 21. In addition, the winding assembly 21 could be supported on the third upper surface 222*a* of the connecting part 222. In a case that the winding assembly 21 comprises two winding coils 210, these two winding coils 210 are separated from each other by the connecting part 222 in order to achieve an insulating efficacy. Moreover, a width $D_1$ of the receptacle 223 is substantially equal to the distance between the two extension arms 222*c* of the connecting part 222. The outer diameter of the winding assembly 21 is dependent on the width $D_1$ of the receptacle 223. The inner diameter of the winding assembly 21 is dependent on the length $D_2$ of the second upper surface 221*a* of the middle part 221.

In addition, the level difference between the second upper surface 221*a* of the middle part 221 and the third upper surface 222*a* of the connecting part 222 define a first height $H_1$. The first height $H_1$ is larger than the second height $H_2$ of the winding assembly 21. After the winding assembly 21 is accommodated within the receptacle 223 of the base 22, the fourth upper surface 210*a* is disposed at a lower level with respect to the second upper surface 221*a* of the middle part 221. As such, the overall volume and the overall height of the inductor 2 are reduced and the layout space of the inductor 2 is saved.

Figure 3A:
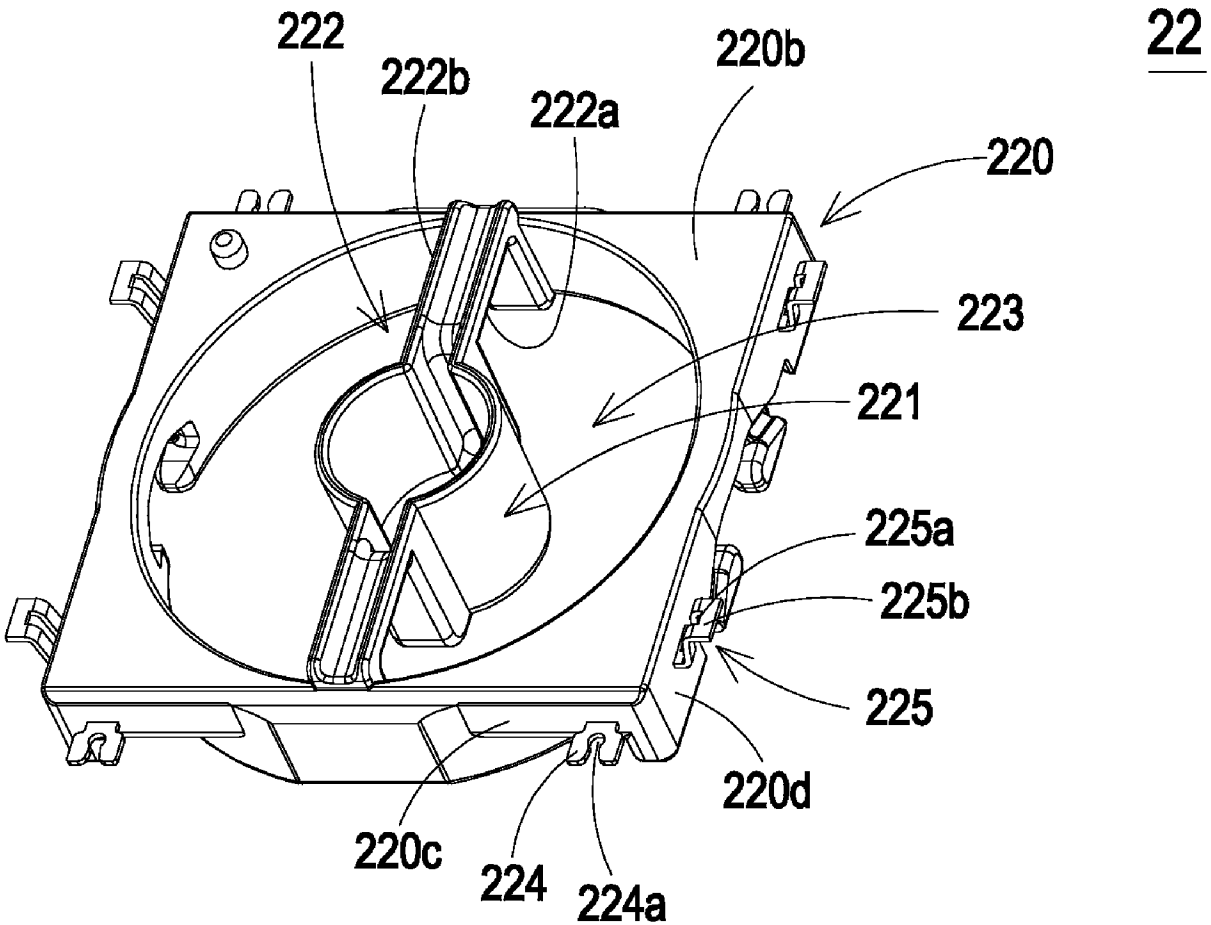
FIG. 3A is a schematic perspective view illustrating the backside of the base as shown in FIG. 2.
Figure 3B:
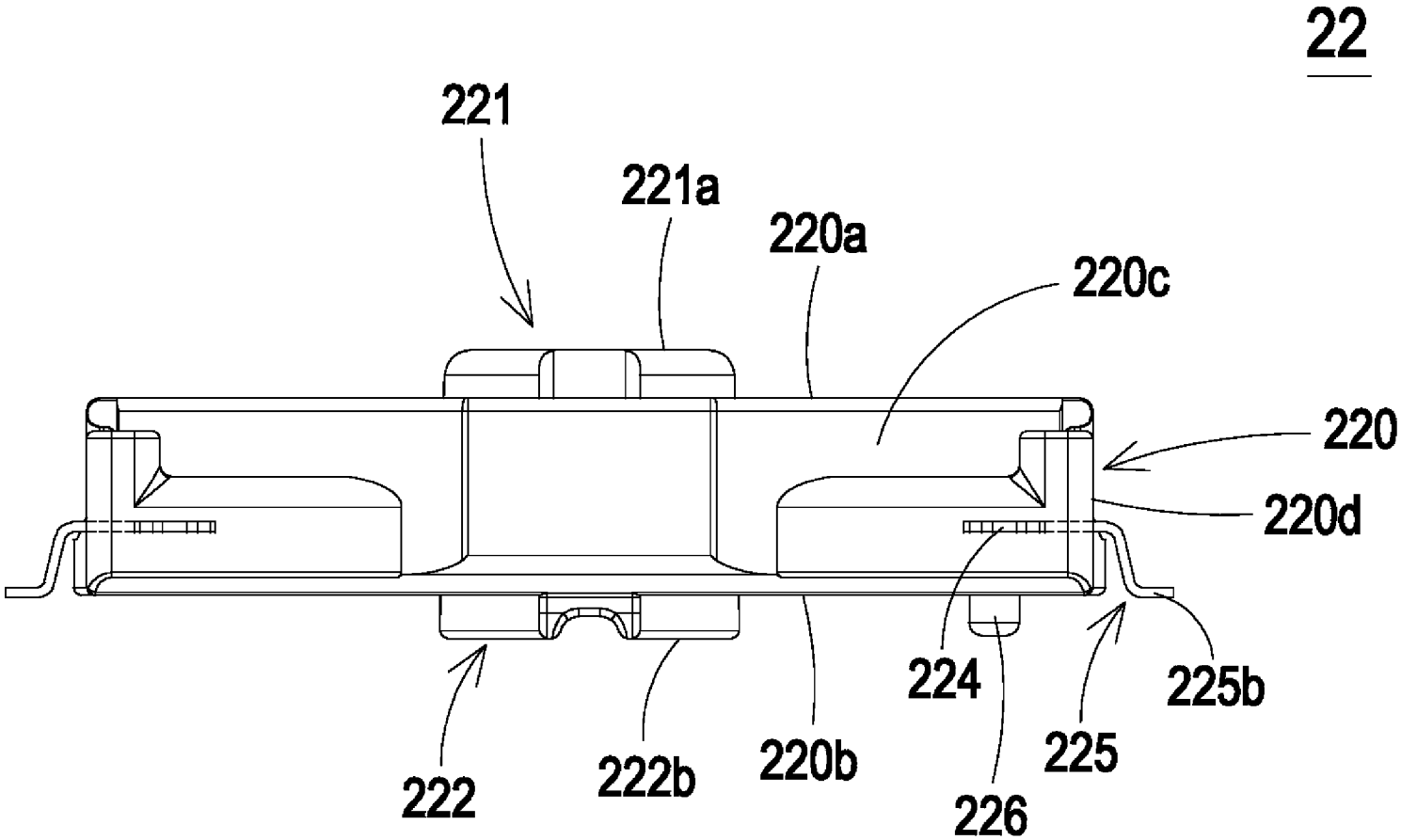
FIG. 3B is a schematic perspective view illustrating the base as shown in FIG. 2.

FIG. 3A is a schematic perspective view illustrating the backside of the base as shown in FIG. 2. FIG. 3B is a schematic perspective view illustrating the base as shown in FIG. 2. Please refer to FIGS. 2, 3A and 3B. The outer frame 220 of the base 22 has a first lower surface 220*b*. The connecting part 222 has the third upper surface 222*a* and a third lower surface 222*b*. The third upper surface 222*a* of the connecting part 222 is disposed at the same level or a lower level with respect to the first lower surface 220*b* of the outer frame 220. The third lower surface 222*b* of the connecting part 222 is disposed at a lower level with respect to the first lower surface 220*b* of the outer frame 220. In other words, the connecting part 222 is disposed at a lower level with respect to the first lower surface 220*b* of the outer frame 220. Since the first height $H_1$ is defined by the level difference between the second upper surface 221*a* of the middle part 221 and the third upper surface 222*a* of the connecting part 222, the depth of the receptacle 223 is increased. Even if the diameter of the winding coil 210 is relatively large and the second height $H_2$ is large, the depth of the receptacle 223 could be extended upwardly or downwardly by heightening the second upper surface 221*a* of the middle part 221 or lowering the third upper surface 222*a* of the connecting part 222. As the first height $H_1$ of the receptacle 223 is increased, the second height $H_2$ of the winding assembly 21 could be increased. Moreover, after the inductor 2 is assembled, the inductor 2 could be mounted on a circuit board (not shown). Preferably, the circuit board has a recess structure (not shown) for accommodating the connecting part 222 of the inductor 2 because the connecting part 222 is disposed at a lower level with respect to the outer frame 220. Since the connecting part 222 is accommodated within the recess structure of the circuit board, the layout space of the inductor 2 is further saved. It is preferred that at least two of the outer frame 220, the middle part 221 and the connecting part 222 are integrally formed.

Please refer to FIGS. 2, 3A and 3B again. A plurality of conducting parts 224 and a plurality of pins 225 corresponding to the conducting parts 224 are formed on the base 22. Each of the conducting parts 224 has a first terminal exposed outside the outer frame 220 and a second terminal buried in the outer frame 220. Similarly, each of the pins 225 has a first terminal exposed outside the outer frame 220 and a second terminal buried in the outer frame 220. The first terminal of the conducting part 224 is connected with the winding coil 210. The second terminal of the conducting part 224 is connected with the second terminal of a corresponding pin 225 (see FIG. 3B). The first terminal of the pin 225 is electrically connected with the circuit board (not shown). Via the conducting parts 224 and the pins 225, the electromagnetic inductance generated by the inductor 2 could be transmitted to the circuit board.

In addition, one of the conducting parts 224 is disposed on a first lateral surface 220*c* of the outer frame 220. The pin 225 corresponding to the conducting part 224 is disposed on a second lateral surface 220*d* of the outer frame 220, wherein the second lateral surface 220*d* is next to the first lateral surface 220*c*. In this embodiment, the base 22 is a SMD base. The pins 225 of the base 22 are trapezoid-shaped pins. Each of the pins 225 has a bottom surface 225*b* lying flat on the circuit board (not shown). After the inductor 2 is placed on the circuit board by a placement machine, the inductor 2 and the circuit board are heated in a reflow furnace and thus the bottom surfaces 225*b* of the pins 225 are welded on the circuit board. The pin 225 further comprises a slot 225*a* in the center thereof. The molten solder paste could be filled into the slot 225 in order to increase the adhesion of the pin 225 to the circuit board. In some embodiments, the base 22 further comprises several auxiliary posts 226. The auxiliary posts 226 are disposed on the first lower surface 220*b* of the outer frame 220 for marking the position of a specified pin. The method of marking the position of the specified pin could be varied according to the practical requirements.

Figure 3C:
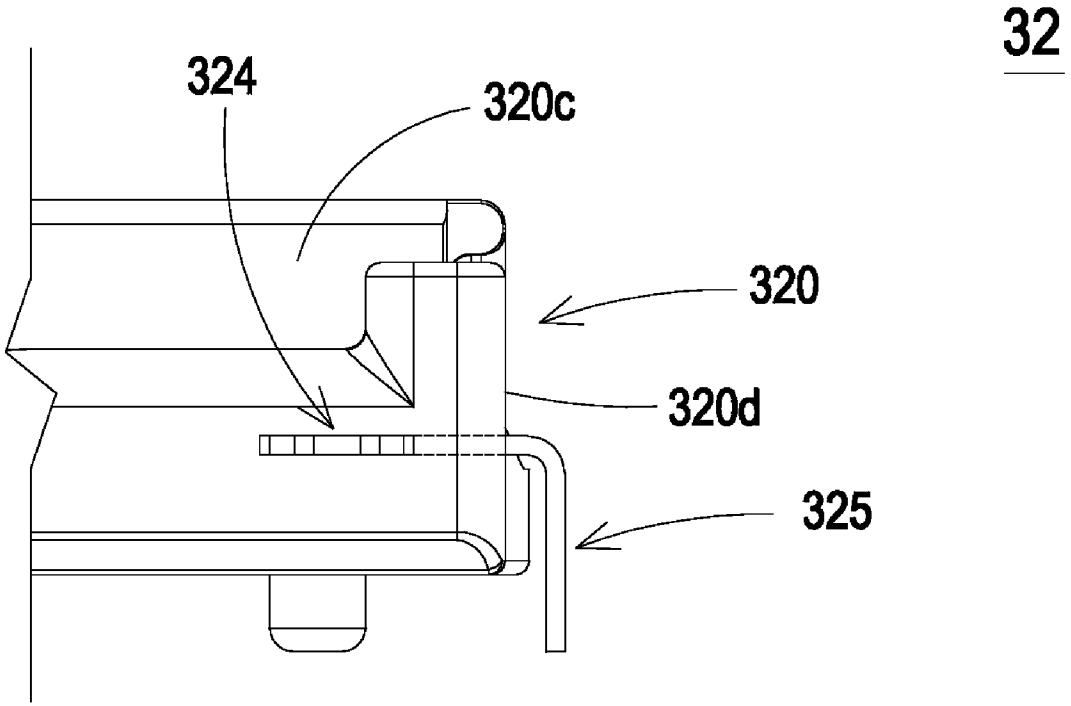
FIG. 3C is a schematic perspective view illustrating a portion of a base of an inductor according to a second embodiment of the present invention.

FIG. 3C is a schematic perspective view illustrating a portion of a base of an inductor according to a second embodiment of the present invention. In this embodiment, the base 32 are DIP (dual in-line package) base. The pins 325 of the base 32 are stitch-shaped pins. As shown in FIG. 3C, the pin 325 is disposed on the second lateral surface 320*d* of the outer frame 320 of the base 32. In addition, a conducting part 324 is disposed on a first lateral surface 320*c* of the outer frame 320. A first terminal of the pin 325 is penetrated through a perforation of the circuit board (not shown). A second terminal of the pin 325 is connected with the conducting part 324. After the inductor and the circuit board are heated in a reflow furnace, the pins 325 are welded on the circuit board and thus the base 32 is fixed on the circuit board.

In the first and second embodiments, the SMD base 22 and the DIP base 32 are substantially identical except that the pins 225 and 325 have different structures. Under this circumstance, a common mold could be employed to produce the bases 22 and 32. For producing the SMD base 22 and the DIP base 32, the trapezoid-shaped pins 225 and the stitch-shaped pins 325 are respectively used. Since the SMD base and the DIP base of the inductor could be produced by a common mold, the fabricating cost of the inductor is reduced.

Figure 4:
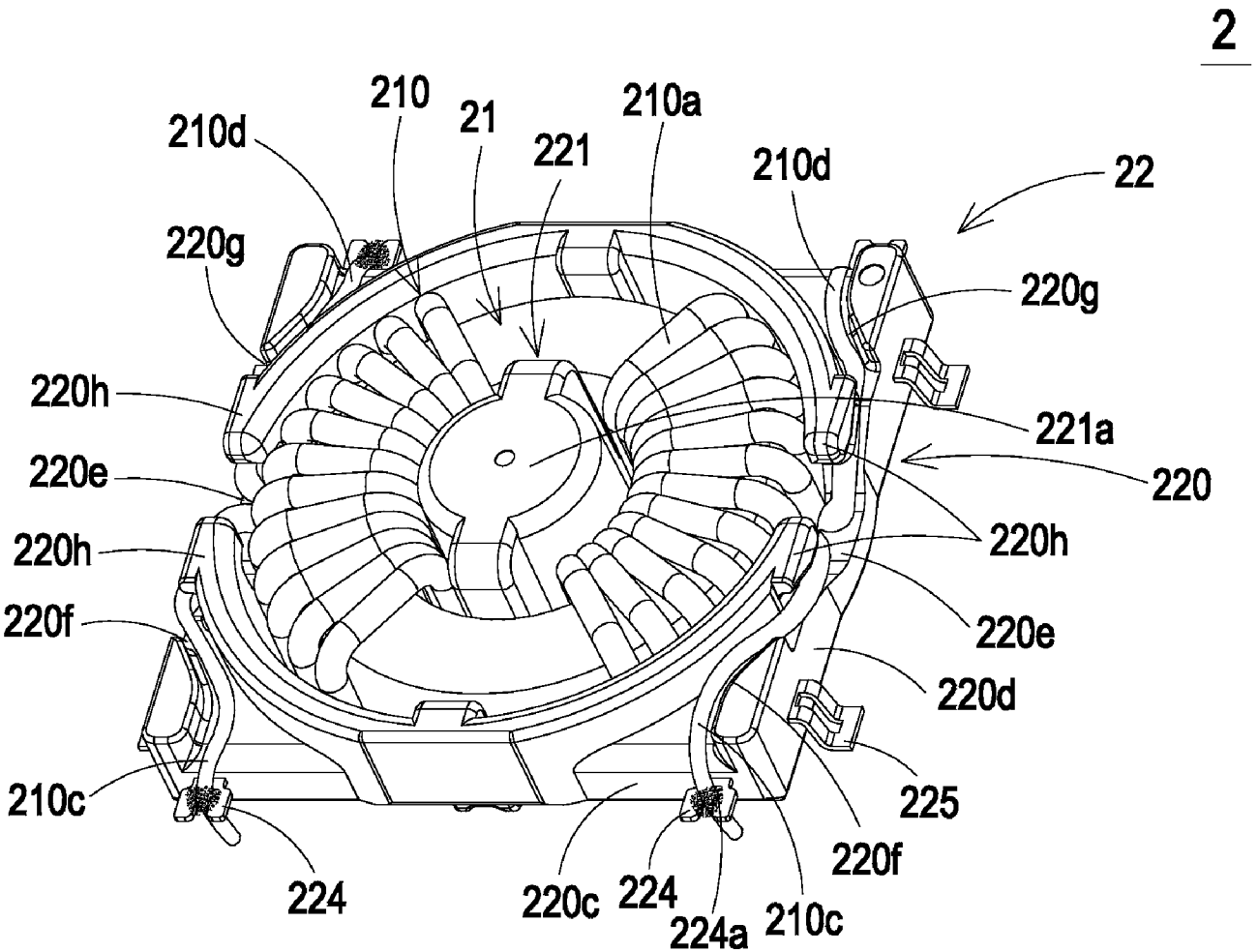
FIG. 4 is a schematic assembled view illustrating the inductor as shown in FIG. 2.

FIG. 4 is a schematic assembled view illustrating the inductor as shown in FIG. 2. For accommodating the winding assembly 21 within the receptacle 223 of the base 22, the channel 212 of the winding assembly 21 is firstly aligned with the middle part 221 of the base 22, and then the middle part 221 of the base 22 penetrates through the channel 212. Since the fourth upper surface 210*a* is disposed at a lower level with respect to the second upper surface 221*a* of the middle part 221, the overall height of the inductor 2 is limited by the level difference between the second upper surface 221*a* and the third upper surface 222*b*. In addition, since the winding assembly 21 is completely accommodated within the receptacle 223 of the base 22, the overall height and the overall volume of the inductor 2 will be reduced. Under this circumstance, the inductor 2 is minimized, the layout space thereof is reduced, and the applications thereof are expanded.

Two notches 220*e* are respectively formed in the second lateral surface 220*d* of the outer frame 220 and the opposed lateral surface of the second lateral surface 220*d*. In addition, guiding grooves 220*f* and 220*g* are formed in the outer frame 220 and beside the protruding blocks 220*h*. The outer frame 220 has protruding blocks 220*h* above the notches 220*e*. After the winding assembly 21 is completely accommodated within the receptacle 223 of the base 22, the input terminals 210*c* and the output terminal 210*d* of the winding coil 210 will be fixed on corresponding conducting parts 224 through the notch 220*e*, the protruding blocks 220*h* and the guiding grooves 220*f*, 220*g*. By means of the protruding blocks 220*h*, the input terminals 210*c* and the output terminal 210*d* of the winding coil 210 will be horizontally guided to the conducting parts 224 and the winding assembly 21 within the receptacle 223 will not be uplifted. The inductor 2 is electrically connected with the circuit board through the conducting parts 224 and the pins 225.

In some embodiments, the conducting parts 224 further have respective openings 224*a* for initially fixing the input terminals 210*c* and the output terminal 210*d* of the winding coil 210 before the welding process. The openings 224*a* are elongated or circular in shapes. After the input terminals 210*c* and the output terminal 210*d* of the winding coil 210 penetrate through the openings 224*a* of corresponding conducting parts 224, the input terminals 210*c* and the output terminal 210*d* are welded on corresponding conducting parts 224. Since the winding coils 210 are connected with corresponding conducting parts 224 and the pins 225 are connected with the circuit board, the possibility of deforming the conducting parts 224 during the inductor 2 is mounted on the circuit board will be minimized. Under this circumstance, the poor contact problem encountered in the prior art will be overcome. In addition, the electrical connection between the inductor 2 and the circuit board is enhanced.

For increasing throughput and yield, the inductor 2 is mounted on the circuit board by an automatic placement process according to the surface mount technology (SMT). The inductor 2 is picked by an automatic placement machine and then placed on a predetermined location of the circuit board. Since the second upper surface 221*a* of the middle part 221 is very flat, the second upper surface 221*a* is served as a sucking surface to be picked up by the automatic placement machine. Moreover, the height and the evenness of the inductor 2 could be measured by placing the detecting probe of a measuring tool on the second upper surface 221*a* of the inductor 2. Since the processes of measuring the height and the evenness of the inductor 2 are very simple, the throughput and yield could be further enhanced.

From the above description, the inductor of the present invention includes a winding assembly and a base. A first height is defined by the level difference between the second upper surface of the middle part and the third upper surface of the connecting part. The second height of the winding assembly is smaller than the first height. After the winding assembly is accommodated within the receptacle, the fourth upper surface of the winding assembly is disposed at a lower level with respect to the second upper surface of the middle part. As a consequence, the overall height of the inductor is limited by the base. In addition, since the second upper surface of the middle part is very flat, the second upper surface is served as sucking surface to be picked up by the automatic placement machine according to the surface mount technology (SMT). By means of the connecting parts and the pins of the base, the electrical connection between the inductor and the circuit board will no longer be adversely affected by the winding coil of the winding assembly, so that the reliability of the inductor is increased. Since the processes of measuring the height and the evenness of the inductor are very simple, the throughput and yield could be further enhanced. Since the SMD base and the DIP base of the inductor could be produced by a common mold, the fabricating cost of the inductor is reduced. Moreover, since the winding assembly is accommodated within the receptacle and the fourth upper surface of the winding assembly is disposed at a lower level with respect to the second upper surface of the base, the overall volume and the overall height of the inductor are controllable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inductor comprising:

a base comprising:

an outer frame having a first upper surface;

a middle part disposed within said outer frame and having a second upper surface; and a connecting part connected with said outer frame and said middle part and having a third upper surface, wherein said connecting part, said outer frame and said middle part collectively define a receptacle; and a winding assembly accommodated within said receptacle and having a fourth upper surface, wherein said second upper surface of said middle part is disposed at a higher level with respect to said first upper surface of said outer frame, a first height is defined by the level difference between said second upper surface of said middle part and said third upper surface of said connecting part, and a second height of said winding assembly is smaller than said first height, so that said fourth upper surface of said winding assembly is disposed at a lower level with respect to said second upper surface of said middle part after said winding assembly is accommodated within said receptacle.

2. The inductor according to claim 1 wherein at least two of said outer frame, said middle part and said connecting part are integrally formed.

3. The inductor according to claim 1 wherein said outer frame further has a first lower surface, said connecting part further has a third lower surface, and said third lower surface of said connecting part is disposed at a lower level with respect to said first lower surface of said outer frame.

4. The inductor according to claim 1 wherein said winding assembly comprises a magnetic core and at least one winding coil, and said at least one winding coil is wound around said magnetic core.

5. The inductor according to claim 4 wherein said magnetic core is ring-shaped and has a channel.

6. The inductor according to claim 5 wherein said middle part of said base penetrates through said channel of said winding assembly such that said winding assembly is accommodated within said receptacle.

7. The inductor according to claim 4 wherein said at least one winding coil comprises two winding coils, which are separated from each other by said connecting part.

8. The inductor according to claim 4 wherein said base further comprises a plurality of conducting parts and a plurality of pins corresponding to said conducting parts, wherein each conducting part has a first terminal connected with said winding coil and a second terminal connected with a corresponding pin.

9. The inductor according to claim 8 wherein said conducting parts are disposed on a first lateral surface of said outer frame, and said pins are disposed on a second lateral surface of said outer frame, wherein said second lateral surface is next to said first lateral surface.

10. The inductor according to claim 8 wherein said winding coil has terminals wound around said conducting parts, so that said winding coil is electrically connected with said conducting parts.

11. The inductor according to claim 8 wherein said conducting parts have respective openings, and said winding coil has terminals penetrating through corresponding openings.

12. The inductor according to claim 8 wherein said pins are electrically connected with a circuit board.

13. A base of an inductor, said inductor comprising a winding assembly, said base comprising:

an outer frame having a first upper surface;

a middle part disposed within said outer frame and having a second upper surface; and a connecting part connected with said outer frame and said middle part and having a third upper surface, wherein said connecting part, said outer frame and said middle part collectively define a receptacle;

wherein said second upper surface of said middle part is disposed at a higher level with respect to said first upper surface of said outer frame, a first height is defined by the level difference between said second upper surface of said middle part and said third upper surface of said connecting part, and a second height of said winding assembly is smaller than said first height, so that a fourth upper surface of said winding assembly is disposed at a lower level with respect to said second upper surface of said middle part after said winding assembly is accommodated within said receptacle.

14. A base of an inductor, said inductor comprising a winding assembly, said base comprising:

an outer frame having a first upper surface;

a middle part disposed within said outer frame and having a second upper surface;

a connecting part connected with said outer frame and said middle and having a third upper surface, said connecting part, said outer frame and said middle part collectively define a receptacle, said second upper surface of said middle part is disposed at a higher level with respect to said first upper surface of said outer frame, a first height is defined by the level difference between said second upper surface of said middle part and said third upper surface of said connecting part, and a second height of said winding assembly is smaller than said first height, so that a fourth upper surface of said winding assembly is disposed at a lower level with respect to said second upper surface of said middle part after said winding assembly is accommodated within said receptacle; and a plurality of conducting parts and a plurality of pins corresponding to said conducting parts, wherein each conducting part has a first terminal connected with said winding assembly and a second terminal buried in said outer frame and electrically connected with a corresponding pin, and said pin is electrically connected to a circuit board.

15. The base according to claim 14 wherein said conducting parts are disposed on a first lateral surface of said outer frame, and said pins are disposed on a second lateral surface of said outer frame, wherein said second lateral surface is next to said first lateral surface.

16. The base according to claim 14 wherein said winding assembly comprises a magnetic core and at least one winding coil, said at least one winding coil is wound around said magnetic core.

17. The base according to claim 16 wherein said first terminal of said conducting part is connected with said winding coil.

18. The base according to claim 16 wherein said winding coil has terminals wound around said conducting parts, so that said winding coil is electrically connected with said conducting parts.

19. The base according to claim 16 wherein said conducting parts have respective openings, and said winding coil has terminals penetrating through corresponding openings.

* * * * *